United States Patent [19]

Rucker

[11] Patent Number: 4,736,535

[45] Date of Patent: Apr. 12, 1988

[54] VERTICAL EMBROIDERY FRAME

[76] Inventor: Doris H. Rucker, 1495 S. Marsh Ave., Reno, Nev. 89509

[21] Appl. No.: 40,362

[22] Filed: Apr. 17, 1987

[51] Int. Cl.[4] ..... D06C 3/08

[52] U.S. Cl. ..... 38/102.3; 38/102.1; 38/102.6; 248/172

[58] Field of Search ..... 38/102.3, 102.1, 102.4, 38/102.5, 102.6, 102.7, 102.8, 102.9; 248/172, 188.5

[56] References Cited

U.S. PATENT DOCUMENTS

| | | | |
|---|---|---|---|
| 1,949,061 | 2/1934 | Male | 38/102.5 |
| 2,318,877 | 5/1943 | Meyer et al. | 38/102.6 |
| 3,774,326 | 11/1973 | Selden | 38/102.4 |
| 3,869,817 | 3/1975 | Bowman | 38/102.4 |
| 4,378,646 | 4/1983 | Mazeika | 38/102.4 X |
| 4,658,521 | 4/1987 | Thorpe | 38/102.6 |
| 4,665,638 | 5/1987 | Morton | 38/102.1 |

*Primary Examiner*—Louis K. Rimrodt

*Assistant Examiner*—J. L. Olds

*Attorney, Agent, or Firm*—Phillips, Moore Lempio & Finley

[57] ABSTRACT

The present invention relates to a vertically oriented frame for embroidery, quilting, rug making, needlepointing or the like. The frame may be attached to a stationary surface, such as a wall panel. It may also be attached to a moveable support which optionally has wheels or casters to be rolled from one place to another. The frame comprises a support frame having multiple securing means which provide a horizontal adjustable retaining area at work space height, and an area above for vertical storage of the quilt. As each portion of the quilt is completed at the horizontal work station formed by a lower retaining bar, adjustable opposite outwardly projecting side bars and adjustable front bar, the quilt is easily stored and displayed vertically until it is complete. Upper horizontal storage support means for the quilt are provided extending over the work station area.

20 Claims, 4 Drawing Sheets

FIGURE 4
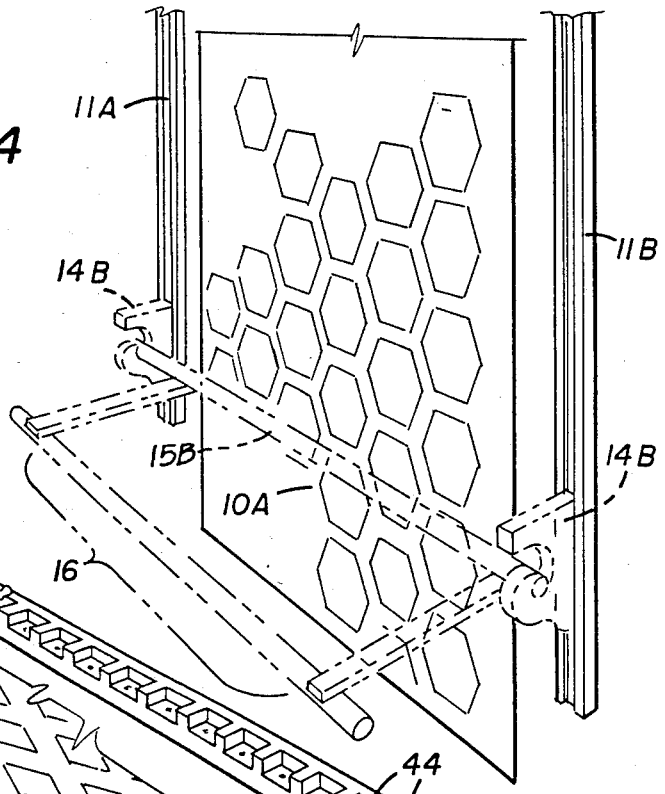
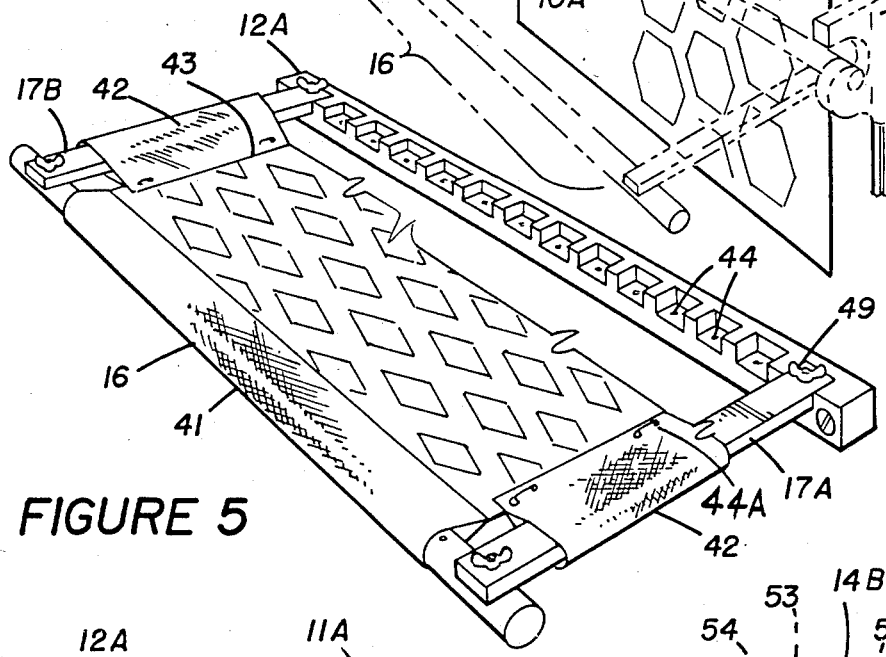
FIGURE 5
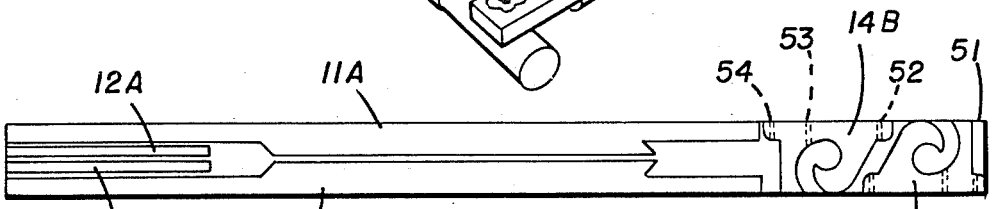
FIGURE 6
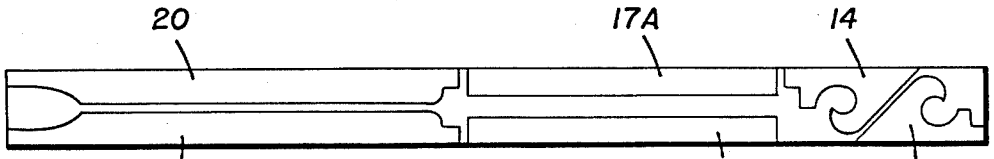
FIGURE 7

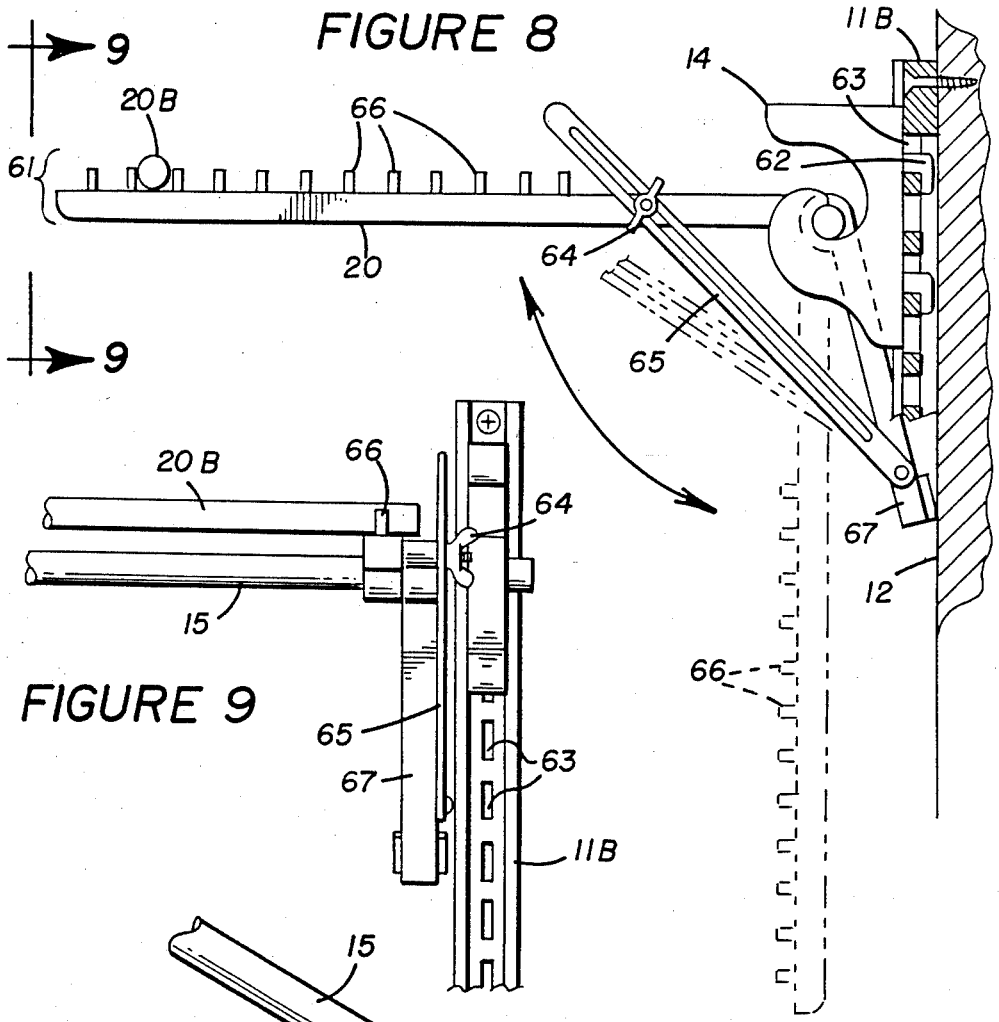
FIGURE 8
FIGURE 9
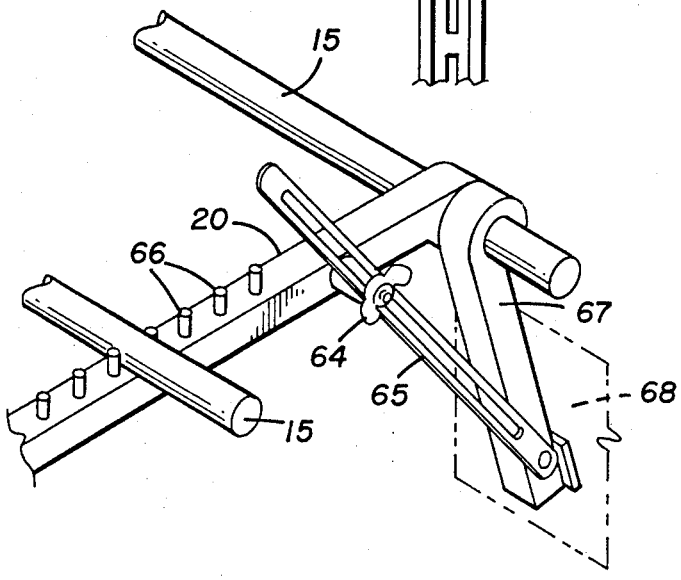
FIGURE 10

VERTICAL EMBROIDERY FRAME

BACKGROUND OF THE INVENTION

1. Field of the Invention

The present invention relates to improvements in embroidery (quilting) frames for making quilts or similar cloth or fabric articles.

2. Description of the Related Art

Quilting frames have been in use for hundreds of years. Usually the frame in the form of an adjustable rectangle is entirely horizontal and supported by four legs about 30 inches from the floor.

Also, some quilters, back in the days when curtain stretchers were a common household item, fastened their quilts to a curtain stretcher, using the stretcher as a quilting frame. In more recent years another common form of quilting frame has been an enlarged "embroidery hoop" in the shape of an oval or large circle.

Any and all of these traditional forms of quilting frames have the disadvantage of taking up a lot of room space, with the exception of the hoop, and the disadvantages of the hoop are that only a small portion of the quilt can be stretched for quilting at one time, and then it requires either a cumbersome stand to hold it, or the quilter is obliged to hold it on the lap while quilting.

In U.S. Pat. No. 2,318,877 J. J. Meyer and F. A. Jones, disclose a collapsible horizontal quilting frame.

In U.S. Pat. No. 4,508,215, I. Marchbank discloses a framed textile fabric assembly for use in embroidery.

Neither of these patents individually or together disclose the present invention.

The present invention overcomes the problems cited above by having a vertical quilting frame (free-standing or attached to a wall) so that the progress of the quilting is always on display, and a minimum of useful floor space in a room is required, and is optionally mobile.

It is desirable to have a frame for use in which a vertical dimension is used for storage of the quilt while having a small horizontal work area.

SUMMARY OF THE INVENTION

The present invention is to an assembly for the vertical holding of a quilt or similar fabric article while it is in various stages of completion. Specifically, the invention relates to a vertical adjustable frame for holding a fabric, comprising the combination of:

(A) an upper supporting bar, (B) a substantially vertical rectangular support area having multiple support means positioned near each vertical edge of the support area to support the upper supporting bar in substantially horizontal position, (C) an upper retaining bar, (D) at least two upper positioned adjustable retention means attached to the support for retaining the upper retaining bar in a substantially horizontal position, (E) a lower retaining bar, (F) at least two lower positioned adjustable retention means attached to the support, and located vertically downward from the upper retention means, for retaining the lower retaining bar in a substantially horizontal position parallel to the upper retaining bar, (G) two lower horizontal outwardly projecting adjustable side bars being connected to (H) a horizontal adjustable front bar, and an adjustable rear wall bar wherein the two opposing side bars, lower retaining bar and front bar define an adjustable horizontal work area for the fabric, wherein the vertical area is used to store the fabric, and wherein the adjustable work area is used as a work station when in the horizontal orientation, and the work area is stored in a vertical orientation.

Optionally, this frame further includes after subpart (H):

(I) two upper horizontally outwardly projecting attached parallel bars at the top of the frame having parallelly spaced retaining means to hold the quilt supporting bar in substantially a horizontal orientation parallel to the upper and lower retaining bars and above the work area.

In another aspect the invention relates to a vertical frame for holding on embroidery, e.g., a quilt during production comprising the combination of:

(a) an upper supporting bar, (b) two substantially parallel upright bars extending upwardly which are detachably attached at the rear of each bar using attachment means to a supporting structure wherein the vertical bars have multiple essentially horizontally and parallelly spaced on each bar supporting bar securing means wherein the upper supporting bar is held in a horizontal position parallel to the quilt, (c) a first retaining bar, (d) two upper upwardly opening C-shaped hooks secured on securing means on each upright bar defining an essentially horizontal holder for the first retaining bar, (e) a second retaining bar, (f) two lower upwardly opening C-shaped hooks secured on said securing means on each upright bar defining a second essentially horizontal holder for the second retaining bar, (g) two lower horizontal essentially parallel adjustable side bars connected to (h) a horizontal adjustable front bar and attached to the rear wall bars, wherein the two side bars, second retaining bar and front bar define an adjustable horizontal work area for producing a quilt, which work area returns to a part of the vertical display/storage configuration in the non-work position.

Optionally, the quilting means frame further includes top outwardly extending means to store and display a portion of the quilt. These additional quilt support means extend beyond the top of the upright support bars substantially and horizontally parallel over the horizontal work area.

BRIEF DESCRIPTION OF THE DRAWINGS

FIG. 4 shows a perspective view of the vertical frame in which the lower horizontal area shown in phantom outline is adjustable and is also capable of a vertical orientation.

FIG. 5 shows a perspective view of the adjustable features of the horizontal work space.

FIG. 6 shows a plan view of portions of the quilting frame, including the adjustable C-shaped hooks as cut from a board or a plank.

FIG. 7 shows a plan view of additional portions of the quilting frame as cut from a board or a plank.

FIG. 8 shows a side view of one embodiment of the upper outwardly projecting horizontal retaining mechanism.

FIG. 9 shows a front view of the upper horizontal retaining mechanism of FIG. 8.

FIG. 10 shows a perspective view of the upper horizontal retaining mechanism of FIGS. 8 and 9.

FIG. 11 shows a perspective breakaway view of the ceiling support of FIG. 1. The upwardly opening channel is partially cut through each ceiling frame to support the upper support bar.

DETAILED DESCRIPTION OF THE INVENTION OR PREFERRED EMBODIMENTS

As defined herein:

"Embroider" or "embroidery" refers to any work with a needle and thread on a fabric to produce a design, or texture or the like. Embroidery includes, for example, quilting (fastening together of layers of fabric), hook and loop fabricating of a rug on a fabric, embroidering a rug, a curtain, a drape, a tapestry, a bedspread, a tablecloth, needlepointing a fabric or the like. This invention does not involve or contemplate the weaving of any fabric to produce a design, such as in a Navajo-like rug.

"Fabric" refers to any article comprising a woven texture such as a rug, a comforter, a quilt, a curtain, a drape, a tapestry, a bedspread or the like.

This invention is a totally new and innovative framing system for embroidery, such as quilting. As used herein the term "quilt" or "quilting" will include any of the terms of "embroider" or "embroidery" as defined herein. The frame is mounted on a wall or a stand, takes up essentially no floor space at all, yet its mechanism allows the quilter or embroiderer to sit comfortably in a chair and quilt with the working portion of the quilt in a horizontal position.

In addition, this quilting frame invention allows the quilt to be displayed on the wall as a decorator item during the quilting process; therefore, there is no need to even want to put it away between quilting sessions.

Further, the present invention may be left (permanently mounted) on the wall even with no quilt attached to it, since the mechanism is designed to look attractive on the wall and it can be used for other purposes when not in use as a quilting frame, such as, a display place for wall hangings, display shelves for ornamental artifacts or houseplants, and hanging mobiles.

The mounting instructions in the specifications for the model of this invention are such that it would even be feasible to remove the quilting frame from its wall mount, store the pieces in a closet, and re-mount it when desired. If this were to be done, only a few Mollie bolt sockets, would be visible—hardly noticeable and easily hidden behind a few objects, such as paintings.

The frame and its accessories can be finished as desired, to complement the decor of whatever room in which it is mounted.

This quilt framing system is fully adjustable, to adapt to any size quilt from a small crib blanket to a California King size bedspread.

The component parts of this invention are made of various materials, such as wood, metal, plastic, fiberglass, composite materials or mixtures thereof, plus the necessary hardware and cloth accessories.

Referring now to FIGS. 1 to 11, the same parts are identified by the same reference number throughout the several views.

Figure 1:
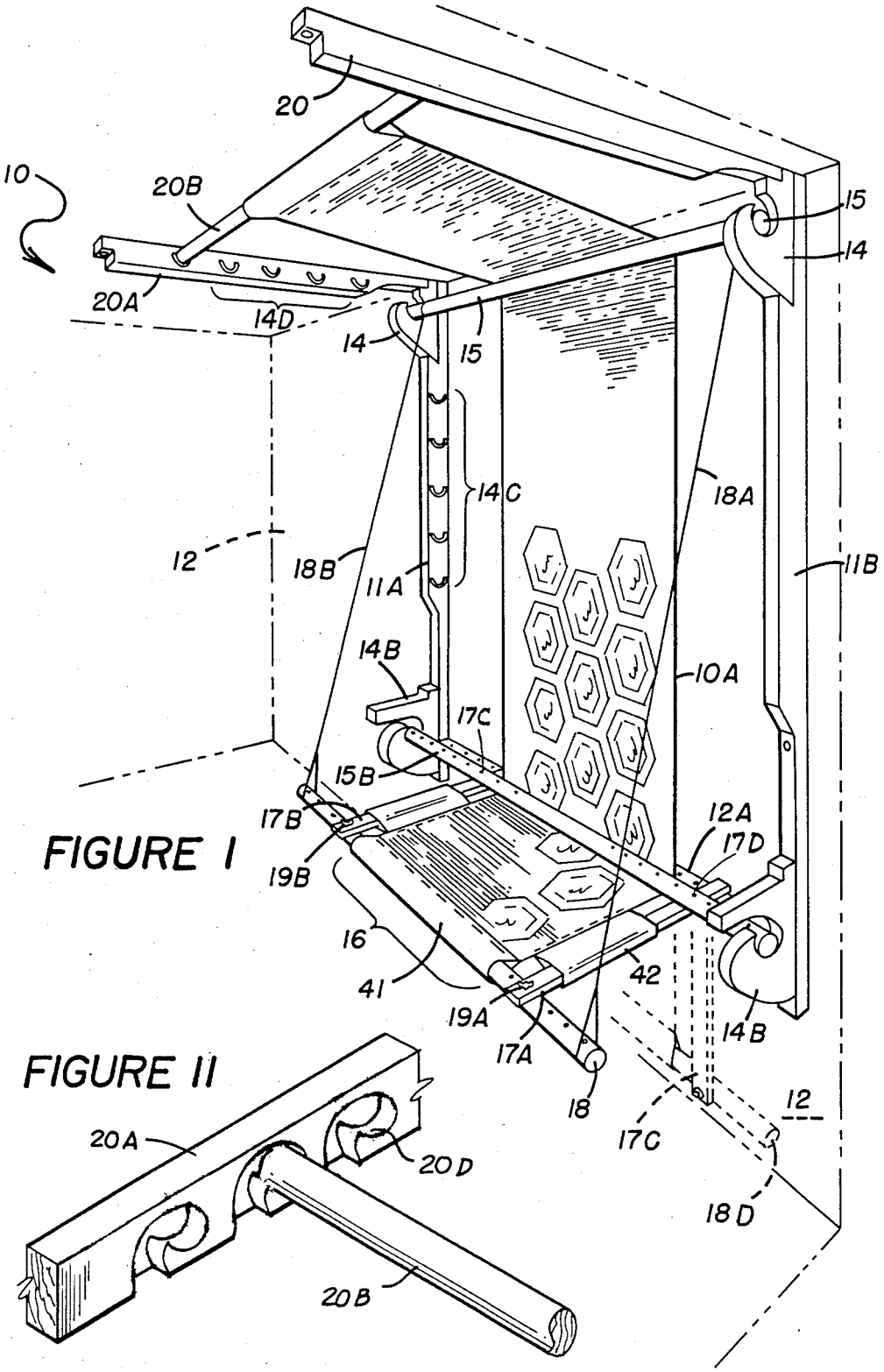
FIG. 1 shows a perspective view of one embodiment of the vertical frame as it is attached to a stationary wall having the vertical storage area for the quilt, having an horizontally outwardly extending upper quilt storage area which is attached to the ceiling and an adjustable lower area which is a quilting work area in the horizontal orientation and a quilt storage area when in the vertical orientation.

In one embodiment, the embroidery (quilting) frame 10 of FIG. 1 for making a quilt 10A (or an embroidery, a rug, a comforter or the like) preferably comprises a pair of substantially vertically positioned side bars 11A or 11B attached to a vertical support, such as wall 12. Side bars 11A and 11B have a number of retaining means 14C on the interior side of each vertical bar. Retaining means 14C which are upwardly opening are permanently attached to each vertical bar. Alternatively, retaining means 14C and 14D may also be upwardly routed grooves 20E of the type shown in FIG. 2 horizontal bars 20 and 20A. It is also contemplated (FIG. 11) to place securing bar 208 in partially routed upwardly opening grooves in horizontal bars and 20 and 20A and on the interior sides vertical bars 11A and 11B. In FIG. 1, each vertical bar 11A and 11B have permanently affixed upwardly opening C-shaped hooks 14, 14A and 14B. These hooks are placed so that the upper retaining bar 15 and lower retaining bar 15B are held in place in essentially a parallel horizontal orientation to each other.

Figures 2, 3:
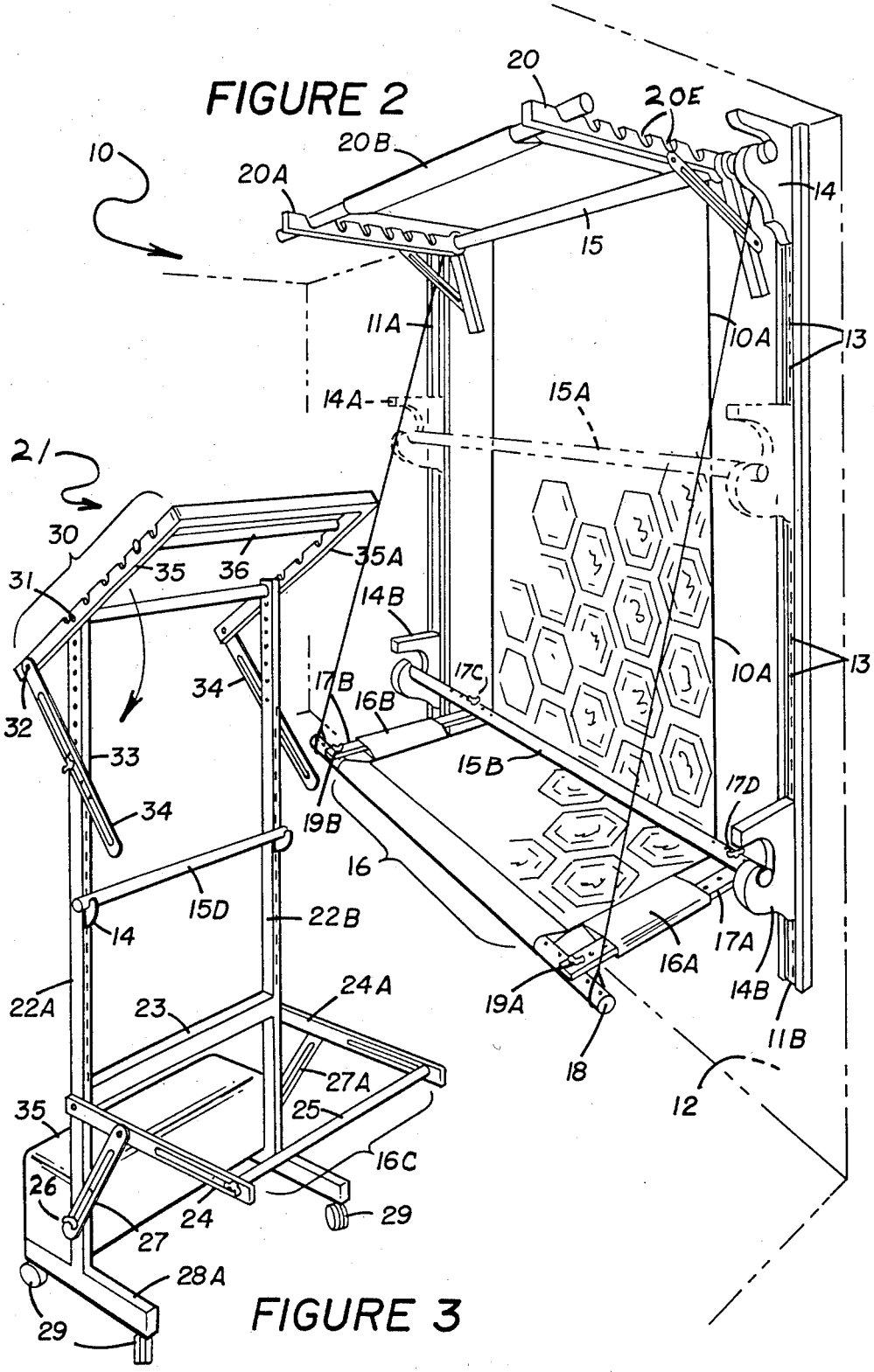
FIG. 2 shows a perspective view of the vertical frame as it is attached to a wall, having the vertical storage area for the quilt, an upper outwardly extending quilt storage area, and a lower horizontal work area.
FIG. 3 shows a perspective of another embodiment of vertical frame, which is free standing, and mobile having the vertical storage area, the upper horizontal storage area and the lower horizontal work area.

The horizontal work area 16 of FIGS. 1, 2 or 5 is formed by adjustable oppositely positioned outwardly projecting parallel side bars 17A and 17B, retaining bar 15B, and adjustable horizontal front bar 18, (and optionally wall plate 12A). That is to say, using the holes shown in lower bar 15B, side bars 17A and 17B may be attached at points 17C and 17D. Therefore lower wall bar (or bars) 12A may be eliminated. The quilt 10A is attached to front bar 18 and side bars 17A and 17B using cloth 41 and 42, safety pins 44A, stitching 43 or the like to obtain the horizontal work surface 16 which can be adjusted using connections at points 19A and 19B. As quilt 10A is formed, the horizontal work space is easily adjusted to accommodate it by rolling the finished quilt about bar 18. Straps 18A and 18B having end loops are used to loop over retaining bar 15 and also bar 18 so that the work area 16 is held horizontal.

The horizontal work area 16 is detachably attached via side bars 17A and 17B to structure support 12A (wall support) by suitable attachment means. One means is to have a peg in bar 17A (or bolt) to fit in the holes shown in wall support 12A.

In an alternative embodiment one can drill vertical holes in retaining bar 15B so that the ends of side bars 17A and 17B are secured to bar 15B using securing means, such as bolt/nut, nail, staple, or the like. In this way the rectangler horizontal work area 16 now is in effect "free floating" (not attached to wall 12 at wall frame 12A). In fact, wall frame 12A can be completely eliminated. When the quilting is finished, straps 18A and 18B can be unfastened and the horizontal work area 16 rotates about retaining bar 15B and hangs in a vertical orientation.

Further, for convenient storage or display, the back of the horizontal work area 16 (shown in phantom outline with side bar 17C and front bar 18D) may be repositioned on support 12A. Bar 18 is detached from its supporting straps 18A and 18B, and the horizontal work area is allowed to hang vertically along the wall and then requires even less floor space in a room.

Ceiling frames 20 and 20A are affixed to the ceiling in a detachable manner by conventional means. On the interior facing sides of each 20 and 20A are affixed bracket support means 14D to support upper support bar 20B. As the quilt 10A is completed and rolled on front bar 18, upper support bar 20B is moved toward the wall then down wall on support brackets 14C.

The components of a frame of this embodiment are described in Table 1.

TABLE 1

LIST OF COMPONENTS AND SPECIFICATIONS FOR WALL HUNG QUILTING FRAME

| COMPONENT | (FIG. 1, component number in parentheses) |
|---|---|
| Ceiling Frames: (Ceiling frame) | Two pieces lumber, 2" × 2⅝" × 45" (20 and 20A). |
| Wall Bar Frames (Vertical side bars) | Two pieces lumber, 2" × 2⅝" × 74½" (11A and 11B). |
| Ceiling Brackets: (Upper retaining means) | Two, cut from 2" × 6" lumber per pattern (14). |
| Wall Brackets: (Lower retaining means) | Two, cut from 2" × 6" lumber per pattern (14B). |
| Wall plates: (Optional wall plates) | Two pieces lumber 2" × 2" × 31" (12A). |
| Arms: (Side bars) | Two pieces lumber 1" × 2" × 20" (17A and 17B). |
| Bottom Frame: (Front bar) | One piece 1¼" closet rod × 116" (18). |
| Top Frame: (Top supporting bar) | One piece 1¼" closet rod × 115½" (20B). |
| Wall Rods: (Upper retaining bar) | Two 120" long: Either metal Cafe rods, 13/16" diameter, or 1¼" wood closet rods (15). |
| Straps: (Straps) | Two, 120" long (including length for forming loops in ends) of upholstery webbing, nylon webbing, sewn from scraps of sturdy cloth, or 1" cotton twill tape (18A and 18B). |
| Sleeves: (Sleeve) | Two, of soft, strong cloth, cut 10" wide × 107" or same length as width of quilt to be quilted; also, two sleeves cut 10" wide by 16" long for arms (41). |
| Hangers: (Multiple support means) | 32, 2" wooden closet rod hangers. (28 to be mounted on ceiling frames, ceiling brackets and wall frames; one for each end of both wall rods (14C). |

Note 1: (Top Frame 20B, Bottom Frame 18 & Wall Rod 15) can be made in two pieces instead of one, by cutting the wood dowel in half and connecting the two pieces with a hollow cylinder, such as a 12" length of brass sink-drain pipe (1¼" inside diameter). This method allows for easier storage if the frame is disassembled, as the pipe slips off easily. No fasteners are necessary to secure the pipe to the wood.
Note 2: Any of the bars of this invention may be constructed of wood, plastic, metal, fiberglass or composites.

The hardware for a quilting frame of this embodiment are described in Table 2.

TABLE 2

HARDWARE FOR HANGING THE QUILTING FRAME

| NO. | ITEMS |
|---|---|
| 2 | Bolts, ¼" × 3" (to fasten arms to bottom frame). |
| 2 | Wing nuts, ¼" for above. |
| 2 | Washers, ¼", for above. |
| 2 | ¼" × 2" Bolts with nuts (for arm pegs). |
| 4 | 12" lengths brass sink-drain pipe, 1¼" inside diameter (for joining 2 halves of top frame, bottom frame, and wall rods, if this style is chosen). |
| 6 | ¼" × 3" bolts to mount brackets to wall frames. |
| 32 | ½" #6 wood screws for mounting hangers. |

TABLE 2-continued

HARDWARE FOR HANGING THE QUILTING FRAME

| | ITEMS |
|---|---|
| 4 | 10/24 Molly Bolts (Mollies) with 10/24 × 4" bolts (for ceiling frames). |
| 6 | 10/24 Mollies with 10/24 × 4" bolts (for wall plates). |
| 4 | 10/24 Mollies with 10/24 × 4" bolts (for mounting wall frame/brackets assemby to wall). |
| 2 | 10/24 Mollies with 10/24 × 4½" bolts (for mounting wall frame/brackets assembly to wall). |
| NOTIONS: | |
| 5 | Dozen large safety pins (for fastenng quilt to sleeves and for looping straps around bottom frame). |
| 6 | Thumb tacks (may be need to keep sleeve from slipping on bottom frame when the quilt is rolled). |

The quilting frame is then used as follows:

1. Lay the quilt-backing, wrong side up, on the floor; place wool or polyester batting on top of it; place quilt-top on batting, right side up. With large safety pins, pin one end of quilt sandwich to one sleeve (sleeve is over top frame), placing pins 4 to 6 inches apart. Alternatively, the quilt is basted with thread (hand or machine stitching). Place several long quilting pins (straight pins) through quilt sandwich, along side edges and scattered throughout middle. Roll quilt sandwich loosely from bottom toward the safety pins.

2. Slide your arms under the rolled quilt and pick up quilt by top frame 20B and hang it in the appropriate ceiling hangers 14D. One needs a small stool to stand on while placing in ceiling hangers. Working from top downward, inspect quilting pins—if the quilt bulges out above pins, one needs to remove the pin and reinsert it, letting weight of quilt smooth out any uneveness between quilt front and quilt back.

If you are hanging the longest size quilt, use the farthest ceiling hanger; if the quilt is shorter, move the top frame to the hangers which make it fit correctly at the bottom horizontal work area 16. Adjustments can be made in the positioning of the safety pins, by folding or lapping the sleeve more onto bottom quilt edge, and sometimes by rolling bottom frame a bit.

3. Slip the straps onto the top wall rod 15, one at each end. Take this wall rod with the straps on it, hold it against the quilt, and push quilt back toward wall until you can place the rod in slots 14D of ceiling brackets 20 and 20A.

4. Place the other wall rod 15B into the slots of wall brackets 14C.

5. Place bolts through appropriate holes of bottom frame 18 and arms 17A and 17B; secure with washers and wing nuts 19A. (Arms 17A and 17B on top of front bottom frame 18.)

6. Place bolt "pegs" of arms into holes in wall plate 12A at sides of quilt. Loop straps 18A and 18B around bottom frame 18 and pin end with safety pin so that bottom frame is held in correct position (arms 17A and 17B about level or horizontal).

7. Bring the bottom of quilt sandwich up to bottom frame and pin it, with large safety pins, to sleeve 41 (which is over bottom frame). There is no need to stretch quilt, as its own weight, hanging, takes care of that. If desired, re-check to see if quilt is hanging evenly, by letting the bottom frame hang against wall and again checking for any bulges at quilting pins.

8. The quilt should be centered on both top and bottom frames. Maintain straps close to brackets regardless of quilt width.

9. Pin sides of quilt to side arm sleeves 42, pulling quilt fairly taut, and smooth.

One is then ready to quilt, or tie, as desired.

10. When not working on the quilting, unhook or unpin straps and let the bottom frame 18 and arms 17A and 17B hang against the wall. The arms have pegs the rear end, which will catch on the top edge of the wall plates 12A in this position. Be sure to lift up on the arms (to remove the pegs from their holes in the wall plates) before letting the bottom frame 18 hang down. Alternatively, if the rear wall plate 12A is eliminated (when bar 15B is attached to arms, 17A and 17B at 17C and 17D) the work area of the quilt will hang vertically from bar 15B.

11. When all the level portion of the quilt is quilted, remove corner bolts and roll the quilted portion onto the bottom frame 18. If necessary, use a few thumb tacks to hold sleeves to bottom frame 18, to keep the frame from spinning inside the roll. Next, move top frame to hanger that will lower the quilt for next quilting position—this should be the second hanger down from the one just used. Replace bolts through bottom frame and arms, insert pegs in wall plate holes, and you are ready to quilt the next section.

You will of course, have to remove the arm sleeves 16A and 16B, or 42, before rolling, and re-attach them to the sides of the next section to be quilted.

12. When half done with the quilting, remove arms 17A and 17B, wall rods; slip sleeves off both top frame 20B and bottom frame 18; turn quilt (attached to sleeves) end-for-end, and slip bottom sleeve onto top frame 20B, and top sleeve onto bottom frame 18. Rehang as in the beginning, displaying the quilted portion on the wall and ceiling, while you quilt the remaining portion (which is now at the bottom).

13. A comforter can be tied on this frame leaving the tie ends on either the front or back of the comforter. To have the tie ends on the back, pull the ends through to the back while working with the frame in usual working position, then hinge the bottom frame up against the body of the quilt or comforter by pinning shorter loops in the straps—thus the back is exposed to view in a vertical position, with the loose yarn ends hanging out. Be certain to tie the ends.

When the entire quilt is finished, remove the quilt from the wall-hanging frame, bind the edges of the quilt as you would any other quilt. Please note that there is a way to avoid binding a quilt. That is, to sew the quilt "sandwich" together like a pillowcase, before attaching it to the sleeves of the frame. To do this, lay the quilt-top good side up on the floor, lay the quilt-backing over it, good side down; lay the batting on the backing; stretch and smooth it all and pin securely around the edges and a few places throughout the middle. Sew around three sides and part of the fourth, leaving a place to turn. Turn, removing all pins. Close the opening on the fourth side with blind stitches. Smooth it out on the floor again, and baste or safety-pin it to the top frame sleeve.

If another quilt is not ready to hang, one can easily suspend any wall hanging from the top wall rod.

When not in use, the top frame 20B can be stored in the grooves 14C, 14D, 20E or 20D. The bottom frame which is joined with brass pipe can be pulled slightly apart, making it longer, and it will then store in the bracket slots with a wall rod. A plant or attractive mobile can be suspended from the top frame (hanging in the ceiling hangers). The arms could be stored on top of the wall plates by simply adding a couple of spots of VELCRO® to hold the arm in place. The wall brackets are designed to accept a small shelf, if desired, on which to set a vase or plant when the frame is not in use, and which can be used to lay scissors and thread while in use.

This frame is designed to fit quilt widths of 114", 110", 108", 102", 96", 90", 81", 74", 66", 60", and 54". Variations from these widths can be accommodated by adjusting the arm sleeves and/or in the positioning of the safety pins. For something very small, such as a quilted wall hanging, an extension to the arm sleeves could be made, or arm sleeves could be made much wider. The smaller size quilt, such as a crib quilt, should be turned cross-wise in the frame.

In another embodiment shown in FIG. 2, et al., improved frame 10 for making a quilt 10A (or an embroidery, a rug or the like), preferably comprises a pair of vertically positioned side bars, 11A and 11B attached to a support, such as wall 12. Bars 11A and 11B have a number of securing means 13 on each vertical bar for detachably attaching the bar retaining means 14 (hooks). In FIG. 2, each bar 11A and 11B have equally spaced holes (slots) 13 upon which the outwardly projecting upwardly opening C-shaped hooks 14, 14A and 14B are positioned. Hooks 14, 14A (phantom) and 14B are placed so that upper retaining bar 15, phantom retaining bar 15A, and lower retaining bar 15B respectively are held in place in essentially a parallel horizontal orientation to each other.

The horizontal work area 16 of FIG. 4, is formed by adjustable oppositely positioned outwardly projecting parallel side bars 17A and 17B and adjustable horizontal front bar 18. The quilt is attached to front bar 18 and side bars 17A and 17B using cloth sleeve 41 and 42, safety pins 44A, stitching 43 or the like to obtain the horizontal work surface 16 which can be adjusted by using different connections at points 19A and 19B. As the quilt 10A is formed, the horizontal work space is easily adjusted to accommodate it. The horizontal work area 16 is attached via 17A and 17B to adjustable structure support 12A behind the quilt of FIG. 2 by any suitable attachment means.

The upper outwardly projecting storage area is shown in FIG. 2. More detailed representations are shown in FIGS. 8, 9 and 10. The upper storage area shows bar 15 and the mechanism to raise and lower bars 20 and 20B is within vertical bars 11A and 11B. It is also contemplated that the mechanism (FIGS. 8, 9 and 10) is supported on each outer side of vertical bars 11A and 11B. In this way more useable space is available to hang and store the quilt.

Further, for convenient storage as is shown in FIGS. 4 and 5 the back of the horizontal work area 16 (in phantom) is allowed to hang vertically along the wall to use even less floor space in a room by detaching from support 12A allowing the horizontal work area to rotate downward.

In another preferred embodiment, the C-shaped hooks 14 are wooden and are cut from a board (or plank) 51 as shown in FIGS. 6 and 7. These hooks may simply have holes 52, 53, 54 drilled into the outwardly projecting face so that the hooks (securing means or bar retaining means) can be simply attached to a wall or support using long screws, nails, pegs, Molly bolts or the like. If the hooks need to be adjusted up or down, it is only necessary then to drill additional holes in the support, i.e. 11A and 11B. The other pieces of the quilting frame are noted by number in FIGS. 6 and 7.

FIG. 5 shows one method of holding side bars 17A and 17B in place using member 12A. A simple board with multiple vertical holes 44 may also secure the side bars 17A and 17B using a bolt and nut 45. Other similar supporting and projecting and fastening means are contemplated within this invention.

FIG. 3 shows a free standing or mobile support 21 for the quilting frame. The fastening means 14 such as hooks are placed in the front surface of vertical bars 22A and 22B to hold in a substantially horizontal positioned upper retaining bar 15D. Horizontal work area 16C is defined by lower retaining bar 23, parallel outwardly projecting opposing side bars 24 and 24A and front bar 25. The horizontal work area 16C can be placed in a vertical position for storage when the quilting is not being performed, by loosening wing nuts 26 and 26A and pushing vertically downward on front bar 25. Braces 27 and 27A hold horizontal work area 16C in place during quilting use. Care must be exercised in the use of the portable frame of FIG. 3. Because of the weight of the quilt, the frame may have a tendency to tip over. It is therefore desirable to use a weight 35 to provide extra stability. Alternatively, the mobile frame may, after being moved into position, be attached to a wall or other vertical object to provide the necessary stability.

The front projecting storage area 30 in FIG. 3 is similar to that of FIG. 2. Bars 35 and 35A adjustably pivot about points 31, 32 and 33 using adjustment bars 34. The quilt is attached to upper support bar 36 and moved down vertical bars 22A and 22B resting on hooks 1A as the quilt progresses and the finished quilt is rolled about bar 25.

FIGS. 8, 9 and 10 describe and show different embodiments of the top storage area 61. In FIG. 8 is shown a hook 14 holding upper retaining bar 15 attached to a support 11B using two downwardly pointing L-shaped hooks 62 in a metal track having multiple slots 63. Side bar 20 and 20A are adjustable by loosening wing nut 64 and moving upper brace 65. Top supporting bar 20B is adjusted by placement between pegs 66. When the top storage area is not in use, it may be placed in a vertical position (shown in phantom outline 67).

While the present invention has been described with reference to the specific embodiments thereof, it should be understood by those skilled in the art of quilting and the making of frames for quilting, embroidery, and the like that various changes may be made and equivalents may be substituted without departing from the true spirit and scope of the present invention. In addition, many modifications may be made to adapt a particular situation, material, or composition, process, process step or steps, or the present objective to the spirit and scope of this invention, without departing from its essential teachings.

We claim:

1. A vertical adjustable frame for holding a fabric comprising the combination of:

(A) an upper support bar, (B) a substantially vertical support having multiple horizontally oriented support means to hold the upper support bar in substantially a horizontal position, (C) an upper retaining bar, (D) two upper positioned adjustable retention means attached to the support for retaining the upper retaining bar in a substantially horizontal position, (E) a lower retaining bar, (F) two lower positioned adjustable retention means attached to the support and vertically downward from the upper retention means for retaining the lower retaining bar in a substantially horizontal position, (G) two horizontal outwardly projecting adjustable side bars connected to (H) a horizontal adjustable front bar, wherein the side bar, lower retaining bar and front bar define an adjustable horizontal work area for the fabric, wherein the vertical space is used to store the fabric and the horizontal work area is used as a work station.

2. The adjustable frame of claim 1 wherein the fabric is a quilt comprising multiple layers.

3. The adjustable frame of claim 1 wherein the fabric is a comforter, bedspread, other bed covering, tablecloth, tapestry, rug or needlepoint.

4. The adjustable frame of claim 1 wherein the upper and lower support means are individual upwardly opening C-shaped hooks.

5. The adjustable frame of claim 1 which further includes after subpart (H):

(I) two upper horizontally outwardly projecting attached parallel bars at the top of the frame having parallelly spaced retaining means to hold the quilt supporting bar in substantially a horizontal orientation parallel to the upper and lower retaining bars and above the work area.

6. The adjustable frame of claim 1 wherein the support is a wall.

7. The adjustable frame of claim 1 wherein the support is a moveable frame mounted on a portable wall section mounted on wheels.

8. The adjustable frame of claim 5 wherein the support is a wall.

9. The adjustable frame of claim 5 wherein the support is a movable frame mounted on wheels.

10. The adjustable frame of claim 1 wherein the frame is constructed substantially of wood, plastic, metal, fiberglass or composite materials.

11. A vertical quilting frame for holding a quilt during production comprising the combination of:

(a) an upper horizontal support bar, (b) two substantially parallel upright bars extending upwardly which are detachably attached at the rear of each bar using support attachment means to a supporting structure wherein the front or inside edges of each of the upright bars have multiple essentially horizontally and parallelly spaced on each vertical bar supporting bar securing means, (c) a first retaining bar, (d) two upper upwardly opening C-shaped hooks secured on said securing means on each upright bar defining a first essentially horizontal holder for a first retaining bar, (e) a second retaining bar, (f) two lower upwardly opening C-shaped hooks secured on said securing means on each upright bar defining a second essentially horizontal holder for a second retaining bar, (g) two horizontal essentially parallel adjustable side bars connected to (h) a horizontal adjustable front supporting bar, wherein the side bars, second retaining bar and front bar define an adjustable horizontal work area for producing a quilt.

12. The quilting frame of claim 11 which further includes after subpart (h):

(i) top extension means to extend and support the quilt substantially horizontally and parallel above the horizontal work area.

13. The quilting frame of claim 11 wherein the frame is attached to a free standing support.

14. The quilting frame of claim 13 wherein the frame has wheels attached at the bottom of the support for mobility.

15. The quilting frame of claim 11 wherein the frame is attached to a stationary wall.

16. The quilting frame of claim 11 wherein the frame comprises wood, metal, plastic, fiberglass or composite materials.

17. The quilting frame of claim 16 wherein the frame comprises wood.

18. The quilting frame of claim 16 wherein the frame comprises fiberglass.

19. The quilting frame of claim 12 wherein the frame is attached to a stationary support.

20. The quilting frame of claim 12 wherein the frame is free standing and mobile and has wheels attached at the bottom.

* * * * *